United States Patent [19]

Greenlee

[11] 4,391,326

[45] Jul. 5, 1983

[54] STINGER ASSEMBLY FOR OIL WELL TOOL

[75] Inventor: Donald R. Greenlee, Cedar Hill, Tex.

[73] Assignee: Dresser Industries, Inc., Dallas, Tex.

[21] Appl. No.: 227,291

[22] Filed: Jan. 22, 1981

[51] Int. Cl.[3] ..... E21B 23/00

[52] U.S. Cl. ..... 166/240; 166/73; 166/217; 166/382; 285/319; 285/360

[58] Field of Search ..... 166/240, 237, 242, 73, 166/118, 243, 123, 217, 382; 285/361, 360, 319, 358

[56] References Cited

U.S. PATENT DOCUMENTS

| | | | |
|---|---|---|---|
| 2,068,659 | 1/1937 | Crickmer | 166/211 |
| 2,252,767 | 8/1941 | Hudson | 294/102 |
| 3,211,479 | 10/1965 | Brown | 285/360 |
| 3,324,952 | 6/1967 | Berryman | 166/240 |
| 3,442,328 | 5/1969 | Nutter | 166/152 |
| 3,446,280 | 5/1969 | Nutter | 166/240 X |
| 3,710,862 | 1/1973 | Young et al. | 166/278 |
| 3,746,090 | 7/1973 | Read et al. | 166/134 |
| 3,912,009 | 10/1975 | Davis, Jr. | 166/240 |
| 4,051,894 | 10/1977 | Goad | 166/73 |
| 4,101,157 | 7/1978 | Richey | 166/240 X |

*Primary Examiner*—Stephen J. Novosad
*Attorney, Agent, or Firm*—W. R. Peoples

[57] ABSTRACT

A stinger assembly for use in releasably connecting an upper section of a tubing string to a tool in a well includes a mandrel with a master cam slot formed therein to define upper and lower support shoulders. An indexable collar telescoped on the mandrel includes a follower which fits within the slot so that as the mandrel is moved vertically, the follower rides within the slot indexing the collar between upper and lower positions relative to the mandrel. A collet is journaled on and carried by the collar and includes a plurality of radially flexible spring-fingers which in the lower position are blocked against deflecting radially inwardly and in the upper position are free to deflect inwardly into an annular recess on the mandrel. The upper shoulder in the master cam slot supports the follower so that the spring-fingers are in registry with the recess to allow the collet to be disconnected from the well tool.

12 Claims, 6 Drawing Figures

STINGER ASSEMBLY FOR OIL WELL TOOL

TECHNICAL FIELD

This invention relates generally to oil and/or gas well production apparatus and, more particularly, to a stinger assembly such as may be used in a well for connecting to and disconnecting from a tool located within the well.

BACKGROUND ART

In an oil or gas well, a stinger assembly may be attached to the lower end of an upper section of tubing to provide a releasable sealed connection with a well tool such as a tubing hanger or packer or the like which supports a lower section of tubing in the well. When installing the well tool in the well, it is desirable that the stinger be locked against separation from the well tool but, once the well tool is anchored in its desired position in the well, it may become necessary to disconnect the stinger from the well tool to allow the upper section of tubing to be pulled from the well for servicing. Apparatus connected to the tubing at the wellhead may make it desirable to be able to disconnect the stinger from the well tool without having to rotate the tubing or slide the upper section of tubing downwardly within the well.

DISCLOSURE OF INVENTION

The present invention aims to provide a new and improved stinger assembly which may be released from connection with the tool anchored in the well by first pulling upwardly on the tubing string and without having to rotate or pressurize the tubing string in order to release the stinger from the tool. Particularly, the invention resides in a novel arrangement for mounting a spring-fingered collet on the stinger mandrel so that the collet may be indexed vertically on the mandrel to position an annular recess on the mandrel in vertical registry with the collet fingers so that the latter are free to deflect inwardly to release from the tool by pulling upwardly on the tubing string. In service use when disconnecting from the tool, the tubing string is first pulled upwardly and then jogged downwardly to properly index the recess relative to the spring-fingers.

More specifically, the invention resides in the construction of the stinger assembly to include a collar connected to the mandrel by way of a cam slot and follower arrangement. The collet is connected rotatably with the collar so that, as the stinger assembly is moved up and down, the follower traverses the cam slot causing the collar and in turn the collet to be indexed between relative vertical positions on the stinger mandrel.

Invention resides also in the novel construction of the stinger assembly to enable the stinger to be reconnected with the tool in the well and in the provision of a guide pin and groove arrangement for preventing relative rotation between the collet and the mandrel in the event it may be desirable to rotate the tubing string in order to disconnect the stinger assembly from the tool in the well.

The foregoing and other advantages of the present invention will become more apparent from the following detailed description when taken in conjunction with the accompanying drawings.

BEST MODE OF CARRYING OUT THE INVENTION

Figures 1A, 1B, 2:
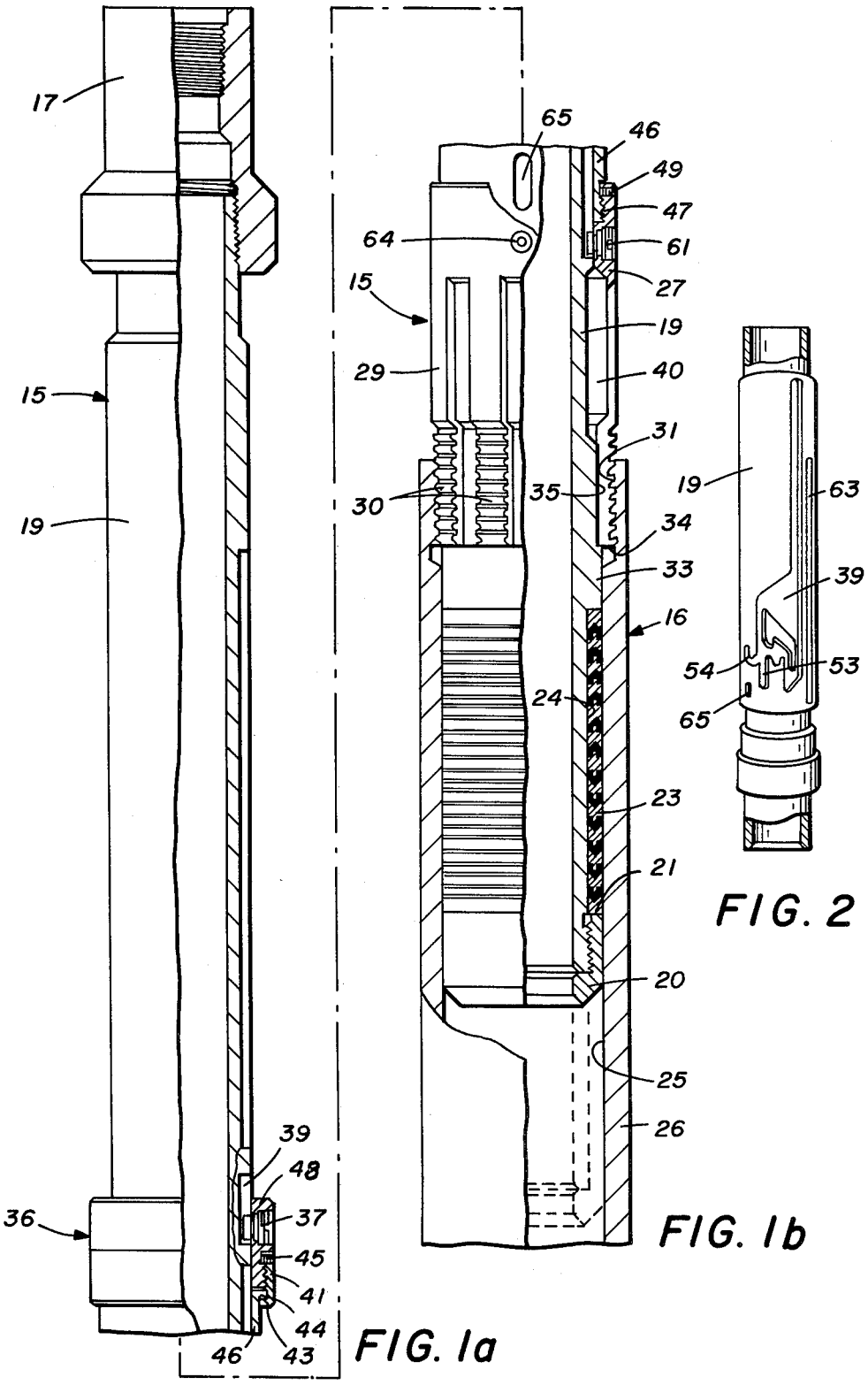
FIGS. 1*a* and 1*b* represent a composite combined elevational and cross-sectional view of a tubing stinger assembly embodying the novel features of the present invention.
FIG. 2 is a perspective view of a mandrel employed in the present stinger assembly.

As shown in the drawings for purposes of illustration, the present invention is embodied in a stinger assembly 15 particularly adapted for use in an oil or gas well for connection to and disconnection from a tool 16 such as a tubing hanger or packer that may be disposed within the well. In use, the stinger 15 is secured to the lower end of an upper section of production tubing (not shown) such as by means of an upper connector 17 secured to a tubular mandrel 19. A bottom connector 20 is threaded on the lower end of the mandrel and includes an upwardly facing shoulder 21 which abuts the lower one of a plurality of annular stacked sealing members or rings 23 to captivate the latter within an annular recess 24 formed on the lower end portion of the mandrel 19. The sealing rings 23 serve to seal against an inside wall 25 of an upwardly extending receptacle 26 of the well tool 16 when the stinger is telescoped into the well tool.

Connected to the stinger mandrel 19 above the sealing rings 23 is a collet 27 including a plurality of radially flexible spring-fingers 29 having externally threaded lower end portions 30 for mating with an internally threaded section 31 within the upper end portion of the well tool receptacle 26 to carry the tool. With the spring-fingers 29 mated with the internally threaded section 31, an annular abuttment 33 on the mandrel 19 engages the lower ends 34 of the fingers 29 to keep the stinger from sliding upwardly within the collet (see FIG. 1*b*). With the collet 27 in this position, an outer surface 35 of the mandrel is located in vertical alignment with the inward side of the spring-fingers to prevent the latter from flexing radially inward. Thus, the well tool may be lowered on the end of the tubing string into a desired position to be anchored in the well.

When installing the tool 16 in the well with the exemplary stinger 15, the tool may be lowered into the well until sealing members (not shown) at the wellhead form a proper seal between the tubing string and the inside of the casing for the well. Thereafter, the tubing string may be lifted a calculated distance to at least compensate for the elasticity in the upper section of the tubing so that once the tool 16 is anchored in place, the upper section of the tubing string may be lowered to properly seat the sealing members at the wellhead and so that the well tool carries all of the weight of a lower section of the tubing string. For example, in FIG. 1*b*, with the well tool anchored in the well, the upper section of the tubing string may be lowered to position the stinger mandrel 19 downwardly within the receptacle 26 in the phantom line position shown. Because of the seating of the sealing members at the well head, it is important to be able to pull the stinger from the well tool 16 without having to further lower the tubing string.

In accordance with the primary aim of the present invention, the collet 27 is mounted on the stinger mandrel 19 in a particularly unique fashion so as to enable the stinger to be removed from the tool receptacle 26 without having to first lower the tubing string. For this purpose, the collet is supported on the mandrel by means of an indexable collar 36 which in turn is supported on the mandrel by connector means in the form of a follower 37 which rides within a master cam slot 39. By jogging the stinger mandrel 19 first upwardly then downwardly and then upwardly again, the follower traverses the cam slot and indexes the collar and the collet 27 upwardly on the stinger mandrel so as to position an annular recess 40 in the outer surface of the mandrel in vertical registry with the spring-fingers 29 freeing the latter for deflection inwardly to disconnect from the tool receptacle 26 as the tubing string is lifted further in the well. With this arrangement, the stinger may be removed from the well tool without having to move the sealing members at the wellhead or rotate the tubing string.

In the present instance, the collar 36 includes an annular body portion 48 with a retaining ring 41 threaded on the lower end portion of the body. The ring extends downwardly below the body and includes an inwardly turned annular flange 43 which extends beneath an outwardly extending flange 44 of a carrier sleeve 46 connected to the collet 27. The retaining ring 41 thus connects the collet to the indexable collar 36 so that the collar may rotate relative to the collet. A set screw 45 secures the retaining ring against unthreading from the collar body 48. Similarly, a threaded lower end portion 47 of the connecting sleeve is held against unthreading from the collet 27 by a second set screw 49.

As shown in FIG. 1*a*, the follower 37 is in the form of a gudgeon pin which is threaded into the collar body 48. The pin projects inwardly from the body and is received within the master cam slot 39. Herein, the cam slot is formed in the outer surface of the mandrel 19 (see also FIG. 2) and a roll-out of the master cam slot is shown in more detail in FIG. 4. More specifically, this slot is configured so as to define vertically spaced first and second shoulders 50 and 51, which when engaged by the follower, serve to support the collar 36 and in turn the collet 27 in vertically spaced lower and upper positions relative to the mandrel 19. With the follower 37 engaging the upper support shoulder 51, the recess 40 in the mandrel is in vertical registry with the spring-fingers 29 of the collet 27 so that when the stinger is pulled upwardly, the spring-fingers ratchet loose from the threaded section 31 of the well tool receptacle 26.

Figure 4:
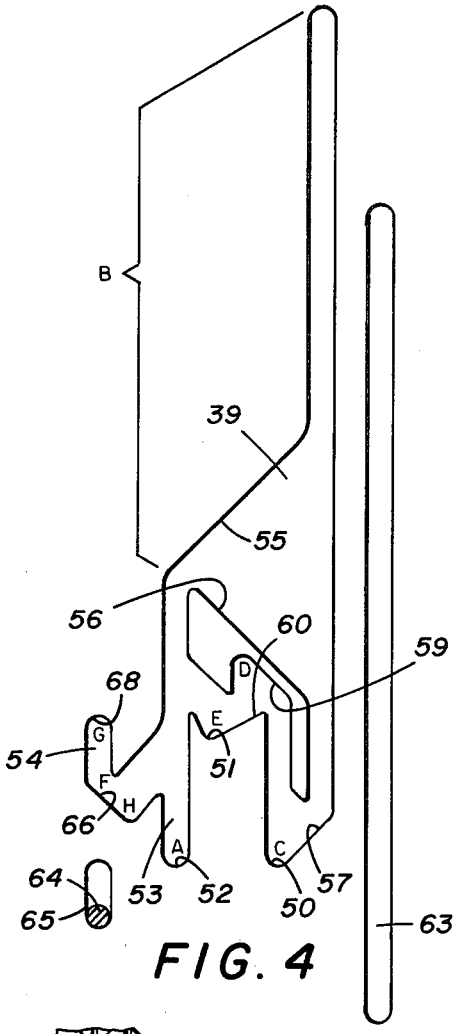
FIG. 4 is a rolled-out pattern of a cam slot employed in the exemplary stinger assembly.
Figure 5:
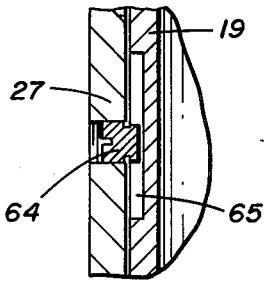
FIG. 5 is an enlarged cross-sectional view of a portion of the exemplary stinger assembly.

The exemplary stinger assembly 15 shown in FIG. 4 includes branch slots 53 and 54 communicating with the master cam slot 39 and is particularly suited for use in setting and retrieving a well tool 16 such as a tubing hanger. In this instance, the branch slot 53 is utilized in initially setting the tubing hanger in the well while the branch slot 54 is utilized in reconnecting the stinger with the tubing hanger.

Figure 3:
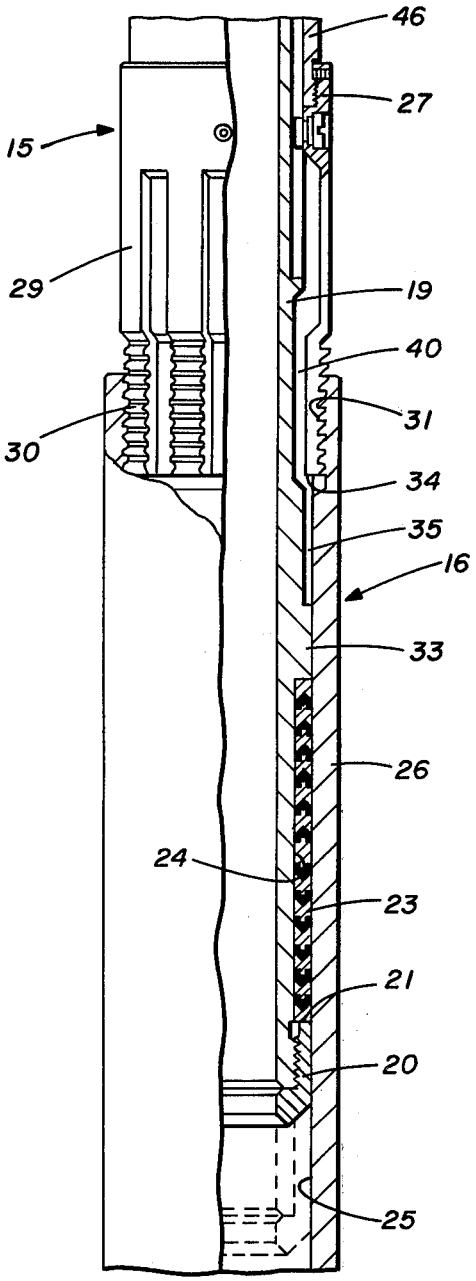
FIG. 3 is a combined elevational and cross-sectional view similar to FIG. 1*b* but showing parts of the stinger assembly in moved positions relative to each other.

Operationally, when lowering the well tool 16 or tubing hanger into the well casing and positioning it as described hereinbefore, the gudgeon pin 37 rests against the lower end 52 of the branch slot 53 at the position indicated as A in FIG. 4 with the collet fingers 29 blocked against deflecting radially inward by the outer surface 35 of the mandrel 19. With the pin 37 in this position, while the tubing hanger is being lowered, the usual weight indicators at the wellhead will show the tubing string weight to equal the weight of the entire length of the string being lowered into the well including the weight of the upper section of the tubing string, the weight of the hanger, and the weight of the lower section of tubing. Once the hanger is set, the tubing string may be lowered with the stinger mandrel 19 telescoping downwardly into the tool receptacle 26 until the sealing members at the wellhead seat. This will position the gudgeon pin 37 somewhere vertically within the area B of the cam slot 39. As the pin rides upwardly within the cam slot to area B, it will engage a first slanted cam surface 55 (extending upwardly to the right as shown in FIG. 4) and cause the collar 36 to pivot relative to the mandrel into vertical alignment with a cam surface 56 slanted downwardly to the right. Within position B, the wellhead weight indicators should sense the weight of the tubing string to be equal to the weight of the upper section of tubing only. Advantageously, in order to remove the stinger assembly 15 from the tool receptacle 26 from this position, the tubing string may be pulled upwardly until the pin 37 engages the downwardly slanted cam surface 56 and rides along that surface indexing the collar 36 further to the right. Upon reaching a substantially vertical section of the cam surface 56, the follower rides downwardly within the cam slot 39 to engage a third cam surface 57 which slants downwardly to the left and leads to the lower cam slot shoulder 50. Upon reaching the cam surface 57, the collar 36 begins to index back to the left until reaching the shoulder 50 at a position C. In the position C, the weight indicated at the surface is equal to the weight of the upper section of the tubing string plus any tension in the string resulting from pulling against the well tool. Herein, the height of position C on the mandrel 19 is equal to the well tool carrying position A with the stinger positioned as illustrated in FIG. 1*b* and may be used to support the tool for removal from the well. From the position C, the stinger may be lowered back into the receptacle 26 so that the pin 37 rides upwardly within the slot 39 to engage cam surface 59 slanting upwardly to the left to cause the collar 36 to index further to the left into a position D. In the position D, the weight indicators should sense weight less than the weight of the upper section of the tubing as that section would be supported somewhat by the well tool acting through the collet 27 and the pin 37 as the latter engages the cam surface 59. In this position, the stinger is located upwardly of its lower most position (shown in phantom FIG. 3) so that the sealing members at the wellhead are spaced upwardly from seating. Thereafter, by pulling upwardly on the tubing string, the pin 37 will ride downwardly relative to the mandrel 19 within the cam slot 39 to engage a cam surface 60 slanting downwardly to the left and causing the collar to index further to the left with the pin 37 seating against the cam shoulder 51 to position the recess 40 in vertical registry with the spring-fingers 29. Accordingly, with further lifting on the tubing string, the fingers will ratchet loose from the tool receptacle 26 freeing the stinger assembly 15 from the tool 16 for removal from the well.

A further advantage of the exemplary stinger assembly 15 resides in the use of a guide pin 61 and an elongated longitudinal groove arrangement in the assembly to provide for an alternative way to disengage the collet 27 from the well tool 16. Herein, the guide pin 61 is connected through the upper end portion of the collet 15 and extends into the groove 63 which is formed in the outer surface of the mandrel 19 so as to prevent relative rotation between the collet and the mandrel 19. The length of the groove 63 is such as to allow a full range of vertical movement of the collar relative to the mandrel without the guide pin engaging either end of the groove. For rotational disconnection of the collet from the well tool 16, the thread surfaces 30 and 31 on the fingers 29 and the upper end portion of the receptacle 26 preferably are left-hand threaded so that, right-hand rotation of the tubing string is transmitted through the guide pin 61 against the side of the groove without risking loosening of any of the joints in the tubing string.

When using the exemplary stinger assembly 15 to retrieve the tool 16 from the well, the gudgeon pin 37 is located within the branch slot 54 by positioning means including a shear pin or screw 64. The latter is threaded through the collet 27 and into a short longitudinal slot 65 formed on the outside surface of the stinger mandrel 19 and is positioned so as to locate the gudgeon pin 37 for movement only between positions G and F (shown in FIG. 4) when the shear screw 64 is located in slot 65. In retrieving, as the stinger assembly 15 is lowered to the tool 16, the lower ends 34 of the collet 15 will engage the upper end of the tool receptacle 26 and the gudgeon pin 37 will slide upwardly within the branch slot 54 into the position G where the pin will hit a reset shoulder 68 defined by the upper end of the slot 54. In the position G, the annular recess 40 is in vertical registry with the lower end portions of the spring-fingers 29 to allow the fingers to deflect radially inward. Accordingly, further downward movement of the stinger mandrel 19 within the well tool receptacle 26 will cause the spring-fingers to ratchet into position with the external threads 30 latching with the internal threads 31. Typically, the ratcheting of the collet into place may be observed on the weight indicator at the wellhead when the weight sensed is indicated as being substantially below its true weight of the upper section of the tubing string. Once the collet is latched with the well tool receptacle 26, upward movement of the tubing string will cause the gudgeon pin 37 to slide downwardly within the slot branch 54 and, at the position F indicated in FIG. 4, the shear screw 64 will be engaged by the lower end of the short slot 65 with further upward movement of the mandrel causing this screw to shear. Once the screw is sheared the gudgeon pin 37 engages a downwardly slanted wall portion 66 of the slot 54 causing the indexing collar 36 to shift to the right (see FIG. 4) with the pin eventually seating against the cam surface 66 at H. From this position H, further upward movement of the mandrel will tend to lift the well tool 16 so that a weight in excess of the weight of the upper section of the tubing is sensed at the surface indicating that the collet fingers are latched. Thereafter, the tubing may be again lowered to eventually seat the upper sealing members at the well head.

For specific well tools, other configurations of the cam slots 39, 53 and 54 may be preferred over the slot configuration described herein. In the present instance, the elongated area B of the master slot 39 provides a substantial length of telescoping between the stinger mandrel 19 and the well tool receptacle 26. When this extent of telescoping is not required, it is possible to reposition the reset shoulder 68 at the upper end of the cam surface 55 and thus avoid separating the branch slot 54 from the master slot with an appropriate length of recess 40 in the mandrel.

As may be appreciated from the foregoing, the present invention brings to the art a new and improved stinger assembly 15 which is particularly adapted to enable the stinger to be disconnected from and reconnected to a well tool 16 without having to sit down on the tubing string from its normally sealed operating position. Herein, this is achieved by means of the indexable collar 36 which carries with it the collet 15 so that the collet may be indexed vertically relative to the mandrel to position spring-fingers 29 as they are either restrained against unlatching or are free to unlatch from the well tool 16. Advantageously, this positioning of the collet may be accomplished by first moving the tubing string upwardly so that the sealing members at the wellhead need not be removed when disconnecting the stinger assembly from the well tool receptacle 26.

The embodiments of the invention in which an exclusive property or privilege is claimed are defined as follows:

1. A stinger assembly for use in releasably connecting an upper section of a tubing string to a tool in a well, said assembly including a mandrel having an upper end portion adapted for connection to the lower end of the upper section of the tubing string and a lower end portion for telescoping with the tool, an indexable collar telescoped onto said mandrel, connector means extending between said mandrel and said collar, a first shoulder on one of said mandrel and said collar for engagement by said connector means to support said collar in a first vertical position relative to said mandrel, a second shoulder on one of said mandrel and said collar for engagement by said connector means to support said collar in a second vertical position relative to said mandrel above said first position, a collet telescoped onto said mandrel and connected rotatably with said collar, said collet having a plurality of radially flexible spring-fingers for latching said stinger to the tool, a first surface on said mandrel to keep said fingers from deflecting radially inward, a second surface on said mandrel spaced radially inward from said first surface to allow said fingers to deflect radially inwardly for connecting with and disconnecting from the tool, and a cam surface on one of said mandrel and said collar for engagement by said connector means for indexing said collar from said first vertical position with said first surface in registery with spring-fingers into said second position with said second surface in registery with said spring-fingers by first moving said mandrel upwardly within the well.

2. A stinger assembly for use in releasably connecting an upper section of a tubing string to a tool in a well including a mandrel having a master cam slot therein defining upper and lower support shoulders, an indexable collar telescoped onto said mandrel, a follower connected to said collar and extending into said master cam slot, a collet journaled on said collar and having a plurality of radially flexible spring-fingers connected thereto for latching said mandrel to the tool, said mandrel having an outer surface for blocking said fingers from deflecting inwardly and a recess wherein said fingers are free to deflect radially inwardly for connecting to and releasing from the tool, said upper support shoulder locating said spring-fingers vertically in registery with said recess when engaging said follower.

3. A stinger assembly as defined by claim 2 including a longitudinal groove formed in the outer surface of said mandrel and spaced angularly from said master cam slot, and a guide pin connected to said collet and extending into said groove to hold said collet against rotation relative to said mandrel.

4. A stinger assembly as defined by claim 2 or 3 including a reset shoulder formed in said mandrel and engagable by said follower to position said collet with said spring-fingers in vertical registry with said recess.

5. A stinger assembly as defined by claim 4 wherein said reset shoulder is the upper end of a branch slot having a lower end portion communicating with said master cam slot, and including means for positioning said follower within said branch slot for abutting engagement with said reset shoulder.

6. A stinger assembly as defined by claim 5 wherein said positioning means includes a shear pin extending between said mandrel and said collet.

7. A stinger assembly as defined by claim 6 wherein said positioning means further includes a short longitudinal slot formed in said mandrel and receiving said shear.

8. A stinger assembly as defined by claim 2 or 3 including of a first branch slot having an upper end portion communicating with said master cam slot and a lower end portion for receiving said follower to support said follower in a running-in position with said spring-fingers blocked against movement radially inward by said outer surface of said mandrel when carrying the tool into the well.

9. A stinger assembly as defined by claim 8 including a second branch slot having a lower end portion communicating with said master cam slot and a upper end portion for receiving said follower to locate said spring-fingers in vertical registery with said recess when lowering said mandrel into the well for connection to the tool when the latter is anchored in the well.

10. A stinger assembly as defined by claim 9 including positioning to locate said follower within said second branch slot.

11. A stinger assembly as defined by claim 10 wherein said positioning means includes a shear pin extending between said mandrel and said collet.

12. A stinger assembly as defined by claim 11 wherein said positioning means further includes a short longitudinal slot formed in said mandrel and receiving said shear pin.

* * * * *